US005530989A

United States Patent [19]

Remmert et al.

[11] Patent Number: 5,530,989

[45] Date of Patent: Jul. 2, 1996

[54] DUAL DUROMETER HANDLES

[75] Inventors: Mark A. Remmert, Saginaw; Richard W. Oertel; Paul J. Moses, Jr., both of Midland, all of Mich.

[73] Assignee: The Dow Chemical Company, Midland, Mich.

[21] Appl. No.: 359,668

[22] Filed: Dec. 20, 1994

[51] Int. Cl.[6] ..... A47B 95/02

[52] U.S. Cl. ..... 16/110 R; 16/DIG. 12

[58] Field of Search ..... 16/110 R, 111 R, 16/116 R, DIG. 12; 29/242; 81/177.1, 489

[56] References Cited

U.S. PATENT DOCUMENTS

| | | | |
|---|---|---|---|
| 2,871,899 | 2/1959 | Coyle et al. . | |
| 3,189,069 | 6/1965 | Stowell | 16/116 R |
| 4,452,862 | 6/1984 | Markert et al. . | |
| 4,721,021 | 1/1988 | Kusznir . | |
| 4,739,536 | 4/1988 | Bandera et al. | 16/111 R |
| 4,953,862 | 9/1990 | Uke et al. . | |
| 5,390,572 | 2/1995 | Gakhar et al. | 16/111 R |

FOREIGN PATENT DOCUMENTS

| | | | |
|---|---|---|---|
| 2635998 | 3/1990 | France | 81/489 |

*Primary Examiner*—Chuck Y. Mah
*Attorney, Agent, or Firm*—Reid S. Willis

[57] ABSTRACT

A dual durometer thermoplastic polyurethane or thermoplastic polyurethane-containing handle suitable for human grip provides both mechanical strength and chemical resistance and can be prepared without the use of adhesives.

8 Claims, 1 Drawing Sheet

DUAL DUROMETER HANDLES

BACKGROUND OF THE INVENTION

This invention relates to a dual durometer thermoplastic polyurethane handle made from rigid and soft thermoplastic polyurethanes.

Hand grips for tools or sporting equipment which provide comfort to the user are known in the art. For example, Uke et al. in U.S. Pat. No. 4,953,862 describes a sleeve of a semisolid or stiff elastomeric material. Smith in U.S. Pat. No. 4,452,862 describes a handle made from rubber encapsulating a relatively hard plastic core. Coyle in U.S. Pat. No. 2,871,899 describes a tool handle made from a soft plastic sleeve surrounding a rigid material. Kusznir in U.S. Pat. No. 4,721,021 describes a handle made of a strong durable elastic material and a soft engaging foamed synthetic rubber pad extending longitudinally from the handle. The pad is pressed into engagement with the durable elastic material.

It would be an advance in the art to provide a dual durometer handle with both mechanical strength and chemical resistance that can be prepared without the use of adhesives.

SUMMARY OF THE INVENTION

The present invention is a dual durometer thermoplastic polyurethane handle suitable for grip by a human hand, comprising:

a) a rigid thermoplastic polyurethane core having a glass transition temperature above about 50° C., or a thermoplastic polyurethane-containing core having a flex modulus of at least 100,000 psi; and b) a soft thermoplastic polyurethane material having a glass transition temperature below about 25° C., or a thermoplastic polyurethane blend having a shore A hardness not greater than about 95, the soft polyurethane material or thermoplastic polyurethane blend superposing at least a portion of the rigid thermoplastic polyurethane or the thermoplastic polyurethane-containing material of (a) so that a hand, upon gripping the handle, contacts the soft thermoplastic polyurethane material.

The handle of the present invention can be made without the use of an adhesive. The handle provides comfort, strength, and chemical resistance.

DETAILED DESCRIPTION OF THE INVENTION

The tool chosen for illustration of a preferred embodiment of the present invention is a screwdriver. It is to be understood that a screwdriver handle is merely illustrative and not meant to restrict the scope of the application.

Figure 1:
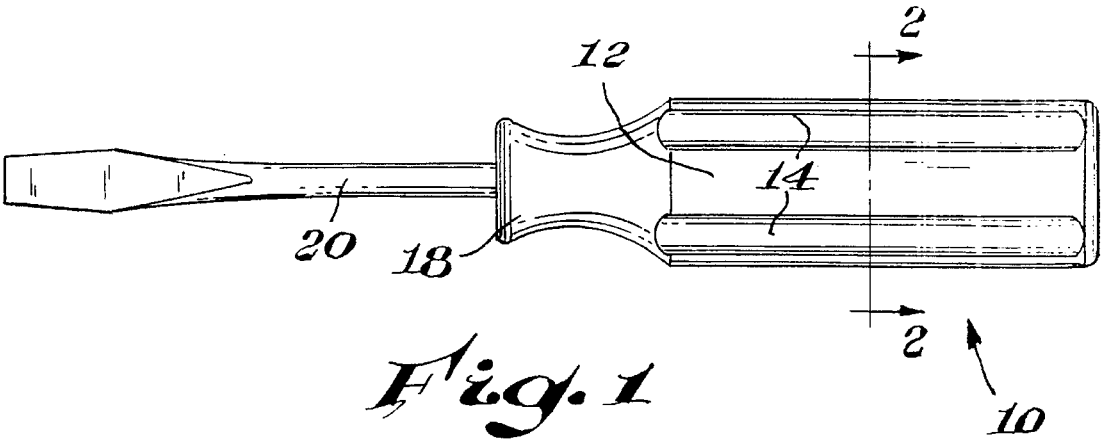
FIG. 1 is a side view of a dual durometer screwdriver having a handle made with the thermoplastic polyurethanes of the present invention.
Figure 2:
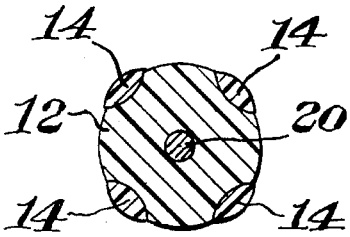
FIG. 2 is a cross-sectional view of taken along the line 2—2 of FIG. 1.
Figure 4:
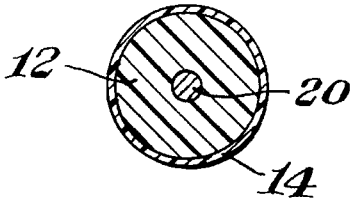
FIG. 4 is a cross-sectional view of taken along the line 4—4 of FIG. 3.

FIG. 1 shows a screwdriver 10 having an elongated rigid thermoplastic polyurethane core 12 having a shank-receiving recess extending inwardly from end 18 to receive a tool bit 20. The core 12 has a plurality of longitudinally extending grooves filled with soft thermoplastic polyurethane grip strips 14. The grip strips 14 protrude above the surface of the core 12 so that a human hand would grip the grip strips 14.

Figure 3:
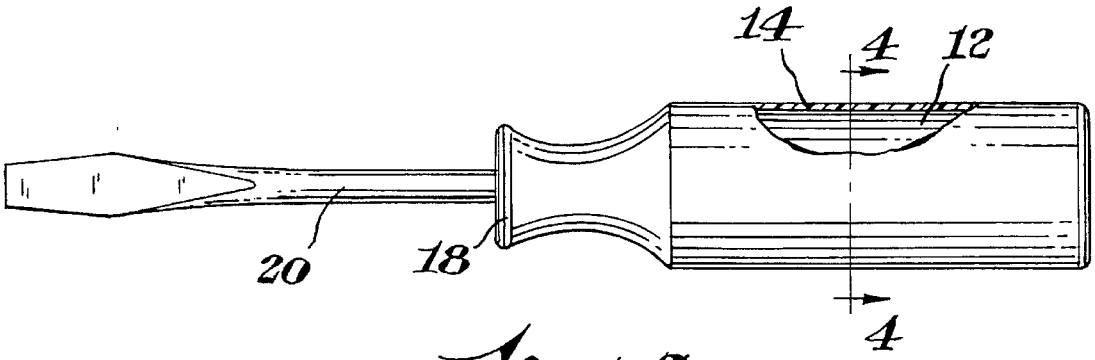
FIG. 3 is a side view of a dual durometer screwdriver handle showing a sheath of a soft polyurethane material covering a core of a rigid thermoplastic polyurethane.

FIG. 3 shows a different embodiment of the screwdriver 10, wherein the core 12 is covered with a soft thermoplastic polyurethane sheath 14.

The core may be a rigid thermoplastic polyurethane material (RTPU) or any thermoplastic polyurethane-containing material having a flex modulus of at least 100,000 psi. The term RTPU refers to a thermoplastic polyurethane (TPU) having a $T_g$ of at least about 50° C. The RTPU has a hard segment that preferably constitutes from about 75, more preferably from about 90, to about 100 weight percent based on the total weight of the RTPU; and a soft segment that preferably constitutes from about 0 to about 25, more preferably to about 10 weight percent based on the total weight of the RTPU.

A TPU that is not by definition an RTPU may be used as the core of the handle of the present invention provided sufficient amounts of suitable fillers, reinforcing fibers, or other thermoplastic materials are added to achieve the desired core flex modulus. Suitable fillers include talc, silica, mica, or glass beads, or mixtures thereof; suitable reinforcing fibers include glass, carbon, or graphite fibers, or mixtures thereof; and suitable thermoplastics include acrylonitrile-butadiene-styrene, polyacetal, nylon, polybutylene terephthalate, polyethylene terephthalate, ionomers, and the like.

The core is superposed by a soft thermoplastic polyurethane (STPU) or any TPU blend having a Shore A hardness of not more than 95. The STPU has a $T_g$ of not more than 25° C. Preferably, the STPU has a hard segment of about 15, more preferably 20, and most preferably 25, to about 50, more preferably 40, and most preferably 30 weight percent based on the total weight of the STPU. Preferably, the STPU has a soft segment of about 50, more preferably 60, and most preferably 70, to about 85, more preferably 80, and most preferably 75 weight percent based on the total weight of the soft TPU.

Examples of materials used to create a TPU blend having a Shore A hardness of not more than 95 include natural butyl rubber, styrene-isoprene-styrene and styrene-butadiene-styrene triblock copolymers, and polyolefinic materials containing maleic anhydride grafts. The amounts of such materials used will, of course vary depending on the material and the hardness desired.

The hard segment of the TPUs is a block derived from the reaction between a polyisocyanate and a difunctional chain extender. Preferred polyisocyanates include aromatic, aliphatic, and cycloaliphatic diisocyanates and combinations thereof. Representative examples of these preferred diisocyanates can be found, for example, in U.S. Pat. Nos. 4,385,133; 4,522,975; and 5,167,899. More preferred diisocyanates include 4,4'-diisocyanatodiphenylmethane, p-phenylene diisocyanate, 1,3-bis(isocyanatomethyl)cyclohexane, 1,4-diisocyanatocyclohexane, hexamethylenediisocyanate, 1,5-naphthalenediisocyanate, 3,3'-dimethyl-4,4'biphenyl diisocyanate, 4,4'-diisocyanatodicyclohexylmethane, and 2,4-toluenediisocyanate, or mixtures thereof. More preferred is 4,4'-diisocyanatodicyclohexylmethane and 4,4'-diisocyanatodiphenylmethane. Most preferred is 4,4'-diisocyanatodiphenylmethane.

The difunctional chain extender is a polyol having a molecular weight of not greater than 200. Preferred chain extenders are ethlyene glycol, 1,3-propanediol, 1,4-butanediol, 1,5-pentanediol, 1,6-hexanediol, diethylene glycol, tetraethylene glycol, neopental glycol, 1,4-cyclohexanedimethanol, 1,4-bishydroxyethylhydroquinone, and mixtures thereof. More preferred chain extenders are 1,4-butanediol, 1,6-hexanediol, and 1,4-cyclohexanedimethanol, and mixtures thereof.

The soft segment of the TPUs is derived from a polyol which has a molecular weight in the range preferably from about 500, more preferably from about 1000, most preferably from about 1500, to preferably about 6000, more preferably to about 4000, and most preferably to about 3000. The polyol is preferably a polyester polyol or a polyether polyol or combinations thereof. Examples of preferred polyester polyols and polyether polyols include polycaprolactone glycol, polyoxyethylene glycol, polyoxypropylene glycol, polyoxyethylene/polyoxypropylene glycol copolymer, polyoxytetramethylene glycol, polyethylene adipate, polybutylene adipate, polyethylene-butylene adipate, and poly-(hexamethylene carbonate glycol, or combinations thereof.

The STPU preferably has a Shore A durometer hardness of 90 or less. Preferably, the STPU has a Shore A durometer hardness of 80 or less, more preferably 75 or less.

The handle of the present invention can be transparent or opaque but is preferably transparent. The shape of the handle is not critical, though it is preferably elongated. The handle can be produced by a variety of techniques, including coextrusion, coinjection, and two-shot overmolding. In the coextrusion technique, for example, a primary extruder extrudes the grooved rigid thermoplastic polyurethane core while a second extruder extrudes the soft thermoplastic polyurethane through a crosshead die into the grooves of the rigid core.

The distribution and the amount of STPU superposing the core is not critical so long as the user feels the STPU when gripping the handle. The core is preferably grooved, and the superposed material is preferably contained in and protruding from the grooves of the core. The configuration of the dual durometer handle may be that of an inner core surrounded by a sheath of STPU or soft TPU-containing material. This embodiment may be produced through a two-shot overmolding process, for example.

Whichever process is used, the core and the superposing material adhere to each other without glue, solvent, or any other adhesive. Though not bound by theory, it is believed that covalent bonds form across the STPU-RTPU interface through depolymerization and repolymerization during the processing of the handle, wherein freed hydroxyl groups from one of the TPUs react with freed isocyanate groups from the other of the TPUs. It is also possible that adhesion takes place through diffusion of polymer chains across the RTPU-STPU interface.

The handle can be any kind of handle that is suitable for human grip. Examples include, but are not restricted to, handles for sports equipment, such as baseball bats, racquets, golf clubs, and waterski tow lines; handles for household items, such as refrigerator doors, oven doors, hand mixers, and door knobs; and hand tools, such as handles for hammers, saws, power drills, torque wrenches, and, of course, screw drivers.

What is claimed is:

1. A dual durometer thermoplastic polyurethane handle suitable for grip by a human hand, comprising:

a) a rigid thermoplastic polyurethane core having a glass transition temperature above about 50° C., or a thermoplastic polyurethane-containing core having a flex modulus of at least 100,000 psi; and b) a soft thermoplastic polyurethane material having a glass transition temperature below about 25° C., or a thermoplastic polyurethane blend having a shore A hardness not greater than about 95, the soft polyurethane material or thermoplastic polyurethane blend superposing at least a portion of the rigid thermoplastic polyurethane or the thermoplastic polyurethane-containing material of (a) so that a hand, upon gripping the handle, contacts the soft thermoplastic polyurethane material.

2. The handle of claim 1 comprising a soft thermoplastic polyurethane material having a glass transition temperature below about 25° C. superposing a rigid thermoplastic polyurethane core having a glass transition temperature above about 50° C.

3. The handle of claim 1 wherein the rigid thermoplastic core is elongated and has a plurality of longitudinally extending grooves wherein the soft thermoplastic material is contained, such that the soft thermoplastic material protrudes above the surface of the rigid thermoplastic polyurethane core.

4. The handle of claim 3 wherein from about 75 to about 100 weight percent of the rigid thermoplastic polyurethane core contains hard segments derived from a diisocyanate selected from the group consisting of 4,4'-diisocyanatodiphenylmethane, p-phenylene diisocyanate, 1,3-bis(isocyanatomethyl)cyclohexane, 1,4-diisocyanatocyclohexane, hexamethylenediisocyanate, 1,5-naphthalenediisocyanate, 3,3'-dimethyl-4,4'-biphenyl diisocyanate, 4,4'-diisocyanatodicyclohexylmethane, and 2,4-toluenediisocyanate.

5. The handle of claim 4 wherein from about 15 to about 40 weight percent of the soft thermoplastic polyurethane material contains hard segments derived from a diisocyanate selected from the group consisting of 4,4'-diisocyanatodiphenylmethane, p-phenylene diisocyanate, 1,3-bis(isocyanatomethyl)cyclohexane, 1,4-diisocyanatocyclohexane, hexamethylenediisocyanate, 1,5-naphthalenediisocyanate, 3,3'-dimethyl-4,4'-biphenyl diisocyanate, 4,4'-diisocyanatodicyclohexylmethane, and 2,4-toluenediisocyanate.

6. The handle of claim 5 wherein at least from about 90 to about 100 weight percent of the rigid thermoplastic polyurethane core and from about 10 to about 25 weight percent of the soft thermoplastic polyurethane material comprises moieties derived from a diisocyanate selected from the group consisting of 4,4'-diisocyanato-diphenylmethane and 4,4'-diisocyanatodicyclohexyl-methane.

7. The handle of claim 6 wherein the rigid thermoplastic polyurethane core is prepared by the reaction of 4,4'-diisocyanatodiphenylmethane and a diol selected from the group consisting of 1,6-hexanediol, 1,4-butanediol, and 1,4-cyclohexanedimethanol.

8. The handle of claim 7 wherein the soft thermoplastic polyurethane is prepared by the reaction of 4,4'-diisocyanatodiphenylmethane; a diol selected from the group consisting of 1,4-butanediol, 1,6-hexanediol and 1,4-cyclohexanedimethanol; and a polyol having a molecular weight in the range of about 1000 to about 2000 and selected from the group consisting of polycaprolactonediol glycol, polyoxyethyleneglycol, polyoxypropylene glycol, polyoxytetramethylene glycol, polyethylene adipate, polybutylene adipate, polyethylene-butylene adipate, and poly(hexamethylene carbonate glycol.

* * * * *